United States Patent [19]

Petrosky

[11] 4,129,951

[45] Dec. 19, 1978

[54] AIR CUSHION SHOE BASE

[76] Inventor: Charles Petrosky, 1118 N. Jefferson St., Arlington, Va. 22205

[21] Appl. No.: 678,658

[22] Filed: Apr. 20, 1976

[51] Int. Cl.[2] ..... A43B 13/20

[52] U.S. Cl. ..... 36/29

[58] Field of Search ..... 36/29, 32 R, 17 R, 3 R, 36/5 B

[56] References Cited

U.S. PATENT DOCUMENTS

| | | | |
|---|---|---|---|
| 1,148,376 | 7/1915 | Gay | 36/29 |
| 2,119,801 | 6/1938 | Vizard | 36/17 R |
| 3,795,994 | 3/1974 | Ava | 36/29 |

FOREIGN PATENT DOCUMENTS

| | | | |
|---|---|---|---|
| 806647 | 5/1952 | Fed. Rep. of Germany | 36/29 |
| 1007060 | 2/1952 | France | 36/29 |
| 1164720 | 5/1958 | France | 36/29 |
| 16240 of | 1893 | United Kingdom | 36/29 |
| 773304 | 4/1957 | United Kingdom | 36/77 |

*Primary Examiner*—James Kee Chi

*Attorney, Agent, or Firm*—James C. Wray

[57] ABSTRACT

An air cushion shoe base has a thick sole and a thick vertical rim across which are formed air tight partitions and an insole. Each partition has a small valving orifice for flowing fluid between sections on opposite sides of a partition. A valve is provided within the rim, and the valve has a central body with a long valve orifice and lateral extensions for joining the body to an inside of the rim. A T-shaped welt extends around an upper peripheral area of the rim and insole for joining the cushion base to a shoe upper.

9 Claims, 5 Drawing Figures

AIR CUSHION SHOE BASE

BACKGROUND OF THE INVENTION

For people who must be on their feet for a long period of time, whether standing still, walking or running, thick soles are extremely useful. Cushion soles are particularly desirable, but some cushion soles have disadvantages of incorrect flexibility, unnatural feelings, or heavy weight.

Some soles which are filled with a pressurized fluid have problems of stability or problems of uniformly filling areas of the sole. In some devices, if a pressurized sole or a pressurized portion of the sole leaks, the sole may become unusable.

Prior Art

Examples of Prior art devices are found in the following United States patents Nos.

| | | |
|---|---|---|
| 2,546,296 | 2,929,192 | 3,114,981 |
| 2,678,506 | 2,930,149 | 3,172,217 |
| 2,710,461 | 2,981,011 | 3,766,669 |
| 2,833,057 | 3,087,262 | |

describe the need for cushion-soled shoes and provide pattern or foam type cushions.

| Patents | | |
|---|---|---|
| 2,605,560 | 2,981,010 | 3,273,265 |
| 2,677,904 | 3,044,190 | 3,785,069 |
| 2,682,712 | 3,079,707 | 3,834,046 |
| 2,863,230 | 3,087,261 | |
| 2,968,105 | 3,120,712 | |

describe pneumatic type cushion soles.

Gouabault U.S. Pat. No. 2,605,560, shows separate valves or single cavities in heels and toes.

Reed describes one overall cavity with a filler valve beneath a heel.

Owsen shows a zip-on pneumatic base with one cavity.

Cortina U.S. Pat. No. 2,863,230 describes a sole having a single pneumatic cavity and a large heel cushion.

Rizzo U.S. Pat. No. 2,968,105 describes a jump boot with a multiple cavity permanently filled sole.

Aaskov U.S. Pat. No. 2,981,010 describes a sandal with a single lower cavity and toe and heel flaps which hold the sole on a foot.

In Hack U.S. Pat. No. 3,079,707 several ripples form plural cavities in a pneumatic sole.

A similar construction is shown in Russell U.S. Pat. No. 3,087,261. Multiple cavities are found in U.S. Pat. No. 3,273,265 to Reinert.

An air insole is described in Brown patent 3,785,069.

Fowler Pat. No. 3,834,046 describes a cushioned insole which has several cavities.

SUMMARY OF THE INVENTION

The present invention is a shoe base which has a sole, a rim extending upward from a periphery of the sole, and partitions extending across the rim and an insole secured to the top of the rim and the partitions.

Aligned metering valving orifices extend through the partitions and through one end of the rim. Preferably the orifices extend through a heel portion and medially through the partitions which are spaced thwartwise across the rim.

In one embodiment of the invention, the sole, rim and partitions are integrally formed. Preferably the sole and rim are relatively thick and the partitions are relatively thin. The sole and rim are formed of a uniform thickness rubber or urethane or other suitable material, and the partitions and insole are similar in thickness. Adjacent edges of the rim, sole, insole and partition are integrally formed or are welded in airtight relationship.

A valve is placed inside the rim near the valve orifice which extends through the rim, and the valve has an enlarged central body in a preferred embodiment, with a valve orifice extending through the central body and being inwardly closed by the body and by air pressure acting on the outside of the body. The body has wings which extend laterally along the rim and which are secured with body to the rim. The cushioned base is filled by inserting a filling needle through the orifice and flowing air through the the needle, thereby slightly expanding the valve body and admitting air to the interior of the cushion base while preventing escape of air around the needle by tightly gripping the needle with the valve body.

In a preferred embodiment of the invention, a T-shaped welt is added to the top of the cushion base and the inner and lower sides of the welt are secured to the base while the upper and inner sides of the welt are secured to a shoe upper. Preferably the welt is extruded and ends of the welt are feathered and welded to form an integral annular welt.

In one form of the invention, the insole is flat and is welded to upper edges of the rim and partitions.

In another form of the invention, the rim and sole are integrally formed, and the insole and partitions are integrally formed, and the bottom edge of the partitions are welded to the sole, while the lateral edges of the partitions and the lower periphery of the insole are welded to the rim.

In the preferred embodiment, the sole and rim flex longitudinally and somewhat laterally, and the partitions and insole flex to a greater degree, both longitudinally and laterally.

In a preferred embodiment, the insole is substantially filled with air slightly above ambient pressure, and the base may be considered suitably filled when the insole has slight curvature between partitions. Stepping on the base in that condition slightly deforms the insole in the areas of maximum pressure and forces air through the metering orifices in the partitions to conform the insole to the bottom of the foot. When one stands still over a long period of time, the insole becomes substantially configured according to the bottom of one's foot and to the pressure on various parts of the foot. As one walks, air leaks very slowly through the metering orifices to the sections on opposite sides of the partitions. As one walks rapidly, very little air is permitted to transfer because of the rapid movement and the slow transfer by the orifices, and one has the feeling of a soft but stable sole.

One object of this invention is the provision of an air cushion shoe base having a flexible floor-contacting sole, a flexible foot-contacting insole positioned above the sole, a rim extending around a periphery of the sole and insole for connecting the sole and insole in airtight relationship, and flexible partitions extending across the rim between the sole and the insole for dividing the shoe base into plural inflatable compartments, each of the partitions having a small valving orifice for flowing air through the valving orifice from one section to another section, and means joining the sole, the rim, the insole and the partitions in airtight relationship.

Another object of the invention is the provision of a cushion shoe base having a one-way valve positioned on a rim between a sole and insole for admitting pressurized air through the one-way valve into a section adjacent the valve and into subsequent sections through restricted valving orifices.

The invention has as another object the provision of a cushion shoe base with a one-way valve having a central valve body with a valve orifice extending through the body and means to close the valve orifice contained in the body and mounting means extending laterally from the body, the mounting means and the body being attached to an inner wall of a rim sealing a sole and insole.

A further object of the invention is the provision of a pneumatic cushion shoe base with a sole constructed of rubber or urethane or other suitable material having a first thickness, a rim constructed of a rubber or urethane material having thicknesses less than the first thickness.

Another object of the invention is the provision of a welt connected to an insole and to a sole rim and having a T-shaped cross section with a relatively long cap portion extending around the rim and extending above the rim, and the T-shaped cross section having a leg portion extending inward over the insole.

A further object of this invention is the provision of a cushion shoe base with a sole, rim and partitions constructed of a rubber or urethane molding and with an insole a adhered to upper edges of the rim and partitions.

Another object of the invention is the provision of a show base sole and rim constructed of unitary rubber or urethane or other suitable material partitions joined to the insole, with lower edges of the partitions welded to the sole and lateral edges of the partitions welded to the rim, and an insole welded to an upper portion of the rim.

This invention has as a further object the provision of a T-shaped rubber or urethane welt for connecting a shoe base to an upper, comprising an integrally formed annular welt having a vertical portion and a horizontal portion extending inward from a medial part of the vertical portion, the vertical portion having a relatively long vertical outer sidewall and a relatively short vertical lower inner wall extending from a bottom of the vertical portion to a lower wall of the horizontal portion, and the vertical portion having a second relatively short inner wall extending from a top of the vertical portion downward to an upper wall of the horizontal portion, means cooperating with the first inner wall for joining the first inner wall to a base of a shoe, means cooperating with the lower wall of the horizontal portion for joining the lower wall to a horizontal wall on the shoe base, and means cooperating with the second relatively short vertical wall and the upper wall of the horizontal portion for joining those walls to a shoe upper.

These and further objects and features of the invention are apparent in the foregoing and ongoing description and in the drawings.

DETAILED DESCRIPTION OF THE DRAWINGS

Figure 1:
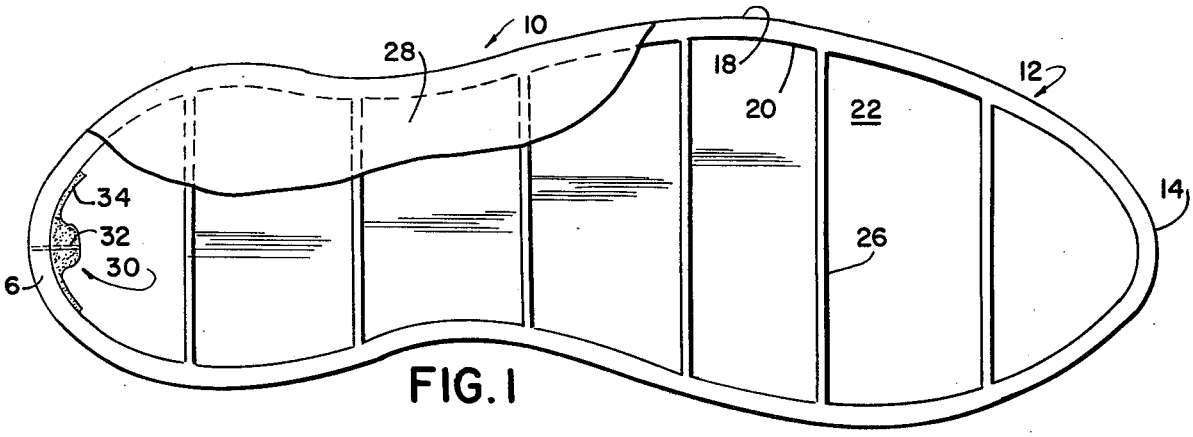
FIG. 1 is a plan view partially cut away, showing the cushion shoe base of the present invention.
Figure 2:
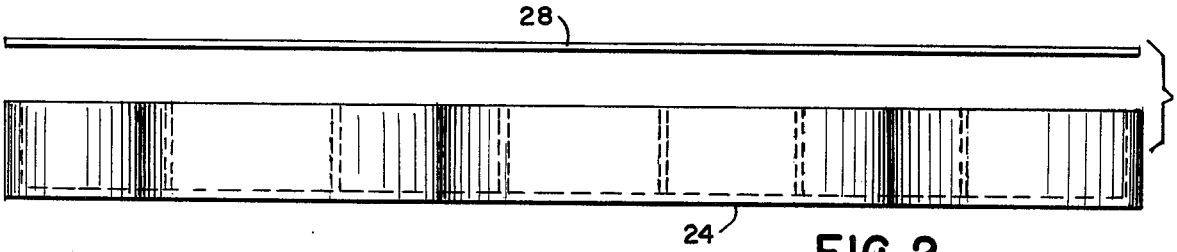
FIG. 2 is an exploded view of the shoe base as shown in FIG. 1.

Referring to FIG. 1, a shoe base is generally indicated by the numeral 10. The shoe base has a rim 12 with a toe portion 14 and heel portion 16. The outer wall 18 of of the rim is substantially smooth, and inner wall 20 is interrupted by partition joints and by a valve. The sole 22 is integrally formed with the rim 12 in a preferred form of the invention. The lower surface 24 of the sole may be porous or roughened to prevent the base from slipping while one is walking.

A plurality of partitions are formed across the top of the sole between opposite inner surfaces 20 of rim 12. In a preferred embodiment of the invention, the partitions 26 are integrally formed with sole 22 and rim 12. Alternatively, partitions 26 are welded to sole 22 and inner surface 20 of rim 12 such as by adhesive bonding. Sole 22 and rim 12 are relatively thick for long wear and for stability. The thwartwise partitions 26 promote the lateral stability of the base, but are relatively thin so that the partitions are substantially unfelt by the wearer.

Partitions 26 divide the base into several longitudinally spaced sections which are filled with air. Insole 28 is joined to upper surfaces of partitions 26 and rim 12 to complete the airtight pockets.

A filling valve 30 is provided at the heel portion 16 of the rim. Valve 30 has a bulbous main body with a central valving orifice 32 which is held closed by forces of the main body of valve 30. Inserting a conventional filling needle into the valve 30 through orifice 32 communicates the holes in the distal end of the needle with the air space and tightly seals the needle with walls of the resilient orifice 32. When the needle is withdrawn, the main body resiliently returns the orifice to its closed condition, and elevated air pressure within the base presses on the semicylindrical wall to further seal the opening. Wings 34 on the valve body are adhesively connected to the inner surface of the rim 12.

Figure 3:
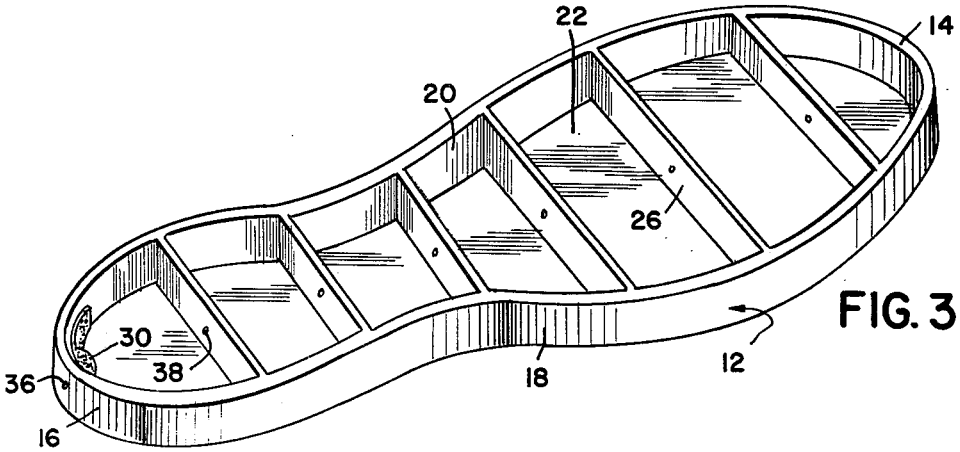
FIG. 3 is a perspective view of the shoe base with the insole removed.

As shown in FIG. 3, an orifice 36 extends through rim 12 into the main body of the valve 30. Orifices 38 in the centers of partitions 26 allow slow passage of fluid between the chambers.

Figure 4:
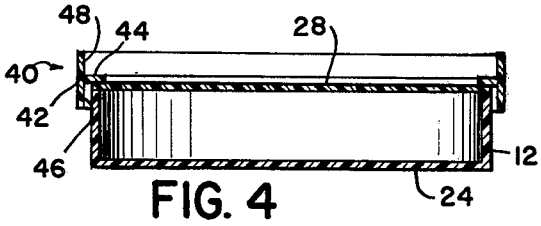
FIG. 4 is an end section showing the preferred welt of the present invention.

As shown in FIG. 4, a preferred form of attaching the base to a shoe comprises a welt 40 having a T-shaped cross section. The vertical cap portion of the T-shaped cross section 42 lies along an upper portion of rim 12 and along a lower portion of the shoe upper. The stem portion 44 of the T-shaped cross section overlies the insole 28 and underlies an edge of the shoe upper. Preferably, the welt 40 is welded or adhesively bonded at its inner surface 46 and at the lower surface of central portion 44 to rim 12 and insole 28. The inner surface 48 of the upper portion of welt 40 and the upper surface of inward extending portion 44 are bonded or stitched to a conventional shoe upper.

Figure 5:
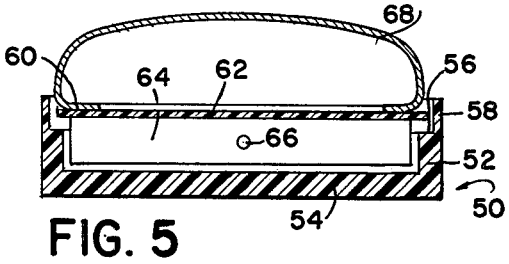
FIG. 5 is an end section showing an alternate form of the invention.

An alternate form of the invention is shown in FIG. 5. There, the shoe base 50 has an integrally formed rim 52 and sole 54. A shelf 56 on an upper portion 58 of rim 52 receives outer edges 60 of an insole 62. Partitions 64 are integrally formed with the insole or are welded or adhesively bonded to the bottom of the insole. A valving orifice 66 is provided in each partition to control the flow of fluid between chambers formed by the partitions.

The partitions and insole are shown spaced from the rim and sole for clarity. In actual practice, the elements are formed with close tolerances so that they may be welded by heating or by applying solvents or adhesives to edges immediately before they are joined.

As shown in FIG. 5, a conventional shoe upper represented by element 68 is bonded to upper outward surfaces of the insole 62 and to inner surfaces of upper portions 58 of the rim 52.

In a preferred embodiment, as shown in FIG. 3, the shoe base rim, sole and partitions are integrally formed, and the aligned metering orifices 36 and 38 are constructed with a hot lance. Subsequently, valve body 30 is joined to the inner wall of the rim.

While the invention has been described with reference to specific embodiments, it will be obvious to those skilled in the art that variations and modifications of the invention may be constructed without departing from the scope of the invention.

I claim:

1. An air cushion shoe base comprising a flexible sole for contacting the floor, a flexible insole positioned above the sole for contacting a foot of a wearer, a rim extending around a periphery of the sole and insole for connecting the sole and insole in airtight relationship, and flexible partitions extending transversely across the rim from side to side between the sole and the insole for dividing the shoe base into plural inflatable transverse compartments, each of the partitions having a small metering orifice for flowing fluid through the metering orifice from one section to another section, and means joining the sole, the rim, the insole and the partitions in airtight relationship.

2. The cushion shoe base of claim 1 further comprising a one-way valve positioned on the rim for admitting pressurized fluid through the one-way valve into a section adjacent the valve.

3. The cushion shoe base of claim 2 wherein the one-way valve comprises a central valve body with a valve orifice extending through the body and means to close the valve orifice contained in the body and mounting means extending laterally from the body, the mounting means and the body being attached to an inner wall of the rim.

4. The cushion shoe base of claim 1 wherein the sole is constructed of a rubber or urethane material having a first thickness, wherein the rim is constructed of a plastic material having the first thickness, and wherein the partitions and insole are constructed of plastic material having thickness less than the first thickness.

5. The cushion shoe base of claim 1 further comprising a welt connected to the insole and to the rim, the welt having a T-shaped cross section with a relatively long cap portion extending around the rim and extending above the rim, and the T-shaped cross section having a leg portion extending inward over the insole.

6. The cushion shoe base of claim 1 wherein the sole, rim and partitions are constructed of a unitary rubber or urethane molding and wherein the insole is adhered to upper edges of the rim and partitions.

7. The shoe base of claim 1 wherein the sole and rim are constructed of a unitary rubber or urethane material and wherein the partitions are joined to the insole and outer and lower edges of the partitions are welded to the rim and sole respectively and the insole is welded to an upper portion of the rim.

8. A shoe base of claim 1 wherein a single orifice is centered in each transverse partition.

9. The shoe base of claim 2 wherein the one way valve is positioned at the rear of the shoe and wherein the orifices in the transverse partitions are aligned with the one way valve.

* * * * *